United States Patent [19]

Morris et al.

[11] Patent Number: 4,822,978

[45] Date of Patent: Apr. 18, 1989

[54] FUSER SYSTEM UTILIZING A PRESSURE WEB

[75] Inventors: Daniel L. Morris, Webster; Michael McManus, Rochester; Robert J. Remis, Ontario, all of N.Y.

[73] Assignee: Xerox Corporation, Stamford, Conn.

[21] Appl. No.: 172,673

[22] Filed: Mar. 24, 1988

[51] Int. Cl.[4] ..... G03G 15/20

[52] U.S. Cl. ..... 219/216; 355/3 FU

[58] Field of Search ..... 219/216, 469, 470, 471; 355/3 FU, 14 FU

[56] References Cited

U.S. PATENT DOCUMENTS

| | | | |
|---|---|---|---|
| 3,243,579 | 3/1966 | Sussin | 219/469 |
| 3,249,738 | 5/1966 | Simm | 219/469 |
| 3,632,984 | 1/1972 | Brownscombe | 219/469 |
| 3,637,976 | 1/1972 | Ohta | 219/469 |
| 3,718,116 | 2/1973 | Thettu | 118/264 |
| 4,112,280 | 9/1978 | Salsich et al. | 219/216 |
| 4,689,471 | 8/1987 | Pirwitz et al. | 219/216 |

*Primary Examiner*—Teresa J. Walberg

[57] ABSTRACT

A low mass fuser roll using system incorporates a flexible web member to maintain copy sheets in biased contact with the fuser roll during the fusing operation. The web is fabricated so as to include perforations in a portion of the web area downstream from the fuser nip permitting moisture buildup from certain types of copy media to be vented. The web also has an electrically conductive coating to reduce friction. In another modification to the fabric web, a teflon strip is incorporated along the width of the web along the strip adjacent to the fuser nip, area to reduce the friction at the nip and reduce jamming or stalling tendencies.

4 Claims, 2 Drawing Sheets

FUSER SYSTEM UTILIZING A PRESSURE WEB

BACKGROUND OF THE INVENTION AND INFORMATION DISCLOSURE STATEMENT

This invention relates generally to an electrophptographic copying apparatus, and, more particularly, to the heat and pressure fixing of toner images formed on a copy substrate by direct contact with a heated fusing member.

In the process of xerography, a light image of an original to be copied is typically recorded in the form of a latent electrostatic image upon a photosensitive member with subsequent rendering of the latent image visible by the application of electroscopic marking particles commonly referred to as toner. The visual toner image is typically transferred from the member to a copy substrate, such as a sheet of plain paper, with subsequent affixing of the image by one of several fusing techniques. A preferred fusing system applies both heat and pressure to the copy substrate.

In a secured fusing system, a fuser roll is used which has an outer surface or covering of polytetrafluoroethylene or silicone rubber, the former being known by the tradename Teflon, to which a release agent such as silicone oil is applied, the thickness of the Teflon being on the order of several mils and the thickness of the oil being less than 1 micron. Silicone based oils which possesses a relatively low surface energy, have been found to be materials that are suitable for use in a heated fuser roll environment where Teflon constitutes the outer surface of the fuser roll. In practice, a thin layer of silicone oil is applied to the surface of the heated roll to form an interface between the roll surface and the toner images carried on the support material.Thus a low surface energy layer is presented to the toner as it passes through the fuser nip and thereby prevents toner from offsetting to the fuser roll surface. A fuser roll construction of this type is disclosed in U.S. Pat. No. 3,718,116 assigned to Xereox Corporation.

While heat and pressure fusers of the type discussed above, are desirable because of their thermal efficiency, they possess some undesirable because of their mechanical complexity, cost, long warm-up times and paper wrinkling. A third type of system is known in the prior art which reduces or eliminates these undesireable characteristics. This system utilizes a relatively low mass fuser roll member of the type disclosed, for example, in U.S. Pat. No. 4,689,471 assigned to Xerox Corporation. As disclosed in this patent, a low mass heated fuser roll coopertes with an elongated web member comprising a woven fabric to form an extended fusing area. One end of the pressure web is fixed while the other end is biased into pressure engagement with the fuser roll forming an entrance nip. The pressure web is an enabling feature of this type of system but the effectiveness depends upon several factors such as the type of copy substrate media being used, and the amount of oil applied to the fuser roll. As one example, the use of high moisture content paper such as tracing paper, tends to create poor fusing conditions because of moisture buildup.

The present invention is, therefore directed to a fusing system utilizing a low mass fuser roll and a pressure web member which is modified to improve the performance of the web with regard to fusing of lightweight or high moisture content copy media. In one embodiment the invention is directed to a heat and pressure fuser apparatus for fixing toner images to copy substrates, the apparatus comprising:

a fuser roll;

means for elevating the temperature of said fuser roll;

a pressure applying member having an elongated surface contacting said fuser roll to form a nip therebetween through which copy substrate pass with toner images carried thereby contacting said fuser roll said member having a conductive surface proximate the fuser roll and;

means for mounting said pressure applying member and for urging substantially the entire surface thereof into pressure engagement with said fuser roll, said pressure applying member comprising a thin web fabricated froma material having a conductive surface proximate the fuser roll.

Further disclosure believed to be material is found U.S. Pat. No. 4,112,280 assigned to Eastman Kodak Company. This patent discloses an apparatus for heat processing a sheet of web material which includes a rotary drum and a guide web of low friction material and an idler web which cooperates with the moving drum to effect feed of the material through the processing path.

BRIEF DESCRIPTION OF THE DRAWS

DETAILED DESCRIPTION OF THE INVENTION

Figure 1:
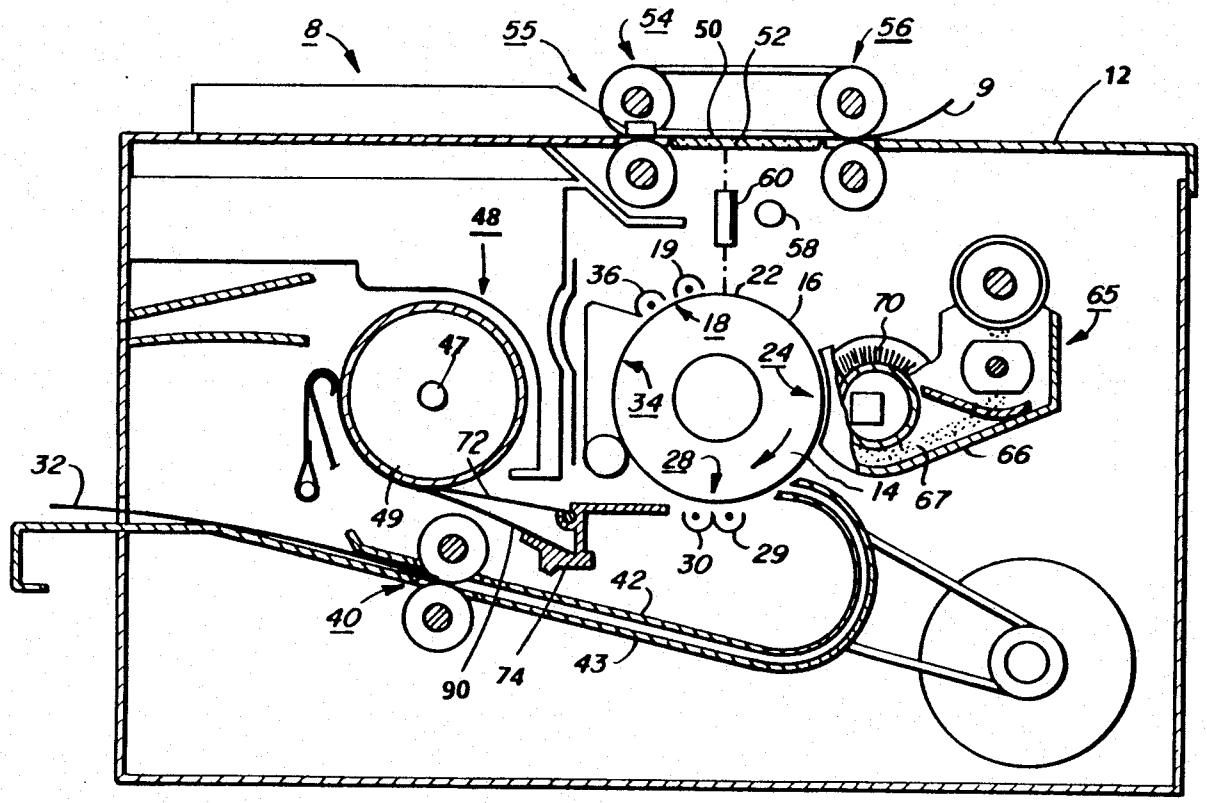
FIG. 1 is a side view in section of a reproductionmachine having the improved heat and pressure fuser of the present invention.

Referring to FIG. 1 of the drawings, there is shown a xerographic type reproduction machine 8 incorporating the present invention. Machine 8 has a suitable frame 12 on which the machine xerographic components are operatively supported. Briefly, as will be familiar to those skilled in the xerographic printing and copying arts, the xerographic components of the machine include a charge retentive recording member, shown here in the form of a rotatable photoreceptor 14. In the exemplary arrangement shown, photoreceptor 14 comprises a drum having a photoconductive surface 16. Other photoreceptor types such as belt, web, etc. may instead be empolyed. Operatively disposed about the periphery of photoreceptor 14 are a charging station 18 with charge corotron 19 for placing a uniform charge on the photoconductive surface 16 of photoreceptor 14, exposure station 22 where the previously charge photoconductive surface 16 is exposed to image rays of a document 9 being copied or reproduced to thereby form a latent electrostatic image on the charge retentive surface; development station 24 where the latent electrostatic image created on photoconductive surface 16 is developed by toner; combination transfer and detack station 28 with transfer corotron 29 detack corotron 30 for sequentially transferring the developed image to a suitable copy substrate material such as a copy sheet 32 brought forward in timed relation with the developed image on photoconductive surface 16 and lessening the forces of attraction between the copy substrate and the charge retentive member; cleaning station 34 and discharge corotron 36 for removing leftover developer from photoconductive surface 16 and nuetralizing residual charges thereon.

A copy sheet 32 is brought forward to transfer station 28 by feed roll pair 40. Sheet guides 42, 43, serve to guide the sheet through an approximately 180 degree turn prior to the copy substrate reaching the transfer station 28. following transfer, the sheet 28 is carried forward to a fusing station 48 where the toner image is contacted by fusing roll 49 forming one member of a heat and pressure fuser. Fusing roll 49 is heated by a suitable heater such as quartz lamp 50 disposed within the interior of roll 49. After fusing, the copy sheet 32 is discharged from the machine.

A transparent platen 50 supports the document 9 as the document is moved past a scan area 52 by a constant velocity type transport 54. As will be understood, scan area 52 is in effect a scan line extending across the width of platen 50 at a desired point along platen 50 where the document is scanned line by line as the document is moved along platen 50 by transport 54. Transport 54 has input and output document feed roll pairs 55, 56 respectively on each side of scan area 52 for moving document 9 across platen 50 at a predetermined speed. Exposure lamp 58 is provided to illuminate a strip-like area of platen 50 at scan area 52. The image rays from the document line scanned are transmitted by a gradient index fiber lens array 60 to exposure station 22 to expose the photoconductive surface 16 of the moving photoreceptor 14.

Developing station 24 includes a developer housing 65, the lower part of which forms a sump 66 for holding a quantity of developer 67. As will be understood by those skilled in the art, developer 67 comprises a mixture of larger carrier particles and smaller toner or ink particles. A rotatable magnetic brush developer roll 70 is disposed in a predetermined operative relation to the photoconductive surface 16 in developer housing 65, roll 70 serving to bring developer from sump 66 into developing relation with photoreceptor 14 to develop the latent electrostatic images formed on the photoconductive surface 16.

The fuser roll 49 comprises a thin-walled thermally conductive tube having a thin (i.e. approximately 0.005 inch (0.01 Centimeters)) coating of silicon rubber on the exterior surface thereof which contacts the toner images on the copy substrate to thereby affix them to the substrate. A release agent management system, not shown, applies a thin layer of silicone oil to the surface of the fuser roll for the prevention of toner offset thereto as well as reducing the torque required to effect rotation of the fuser roll. In one operative embodiment of the fuser roll its diameter was 3.3 inches and had a length of 40 inches. This embodiment is typically used to fuse images on copy substrates that are 3 feet (0.91 Meters) wide by 4 feet (1.22 Meters) in length.

Figure 2:
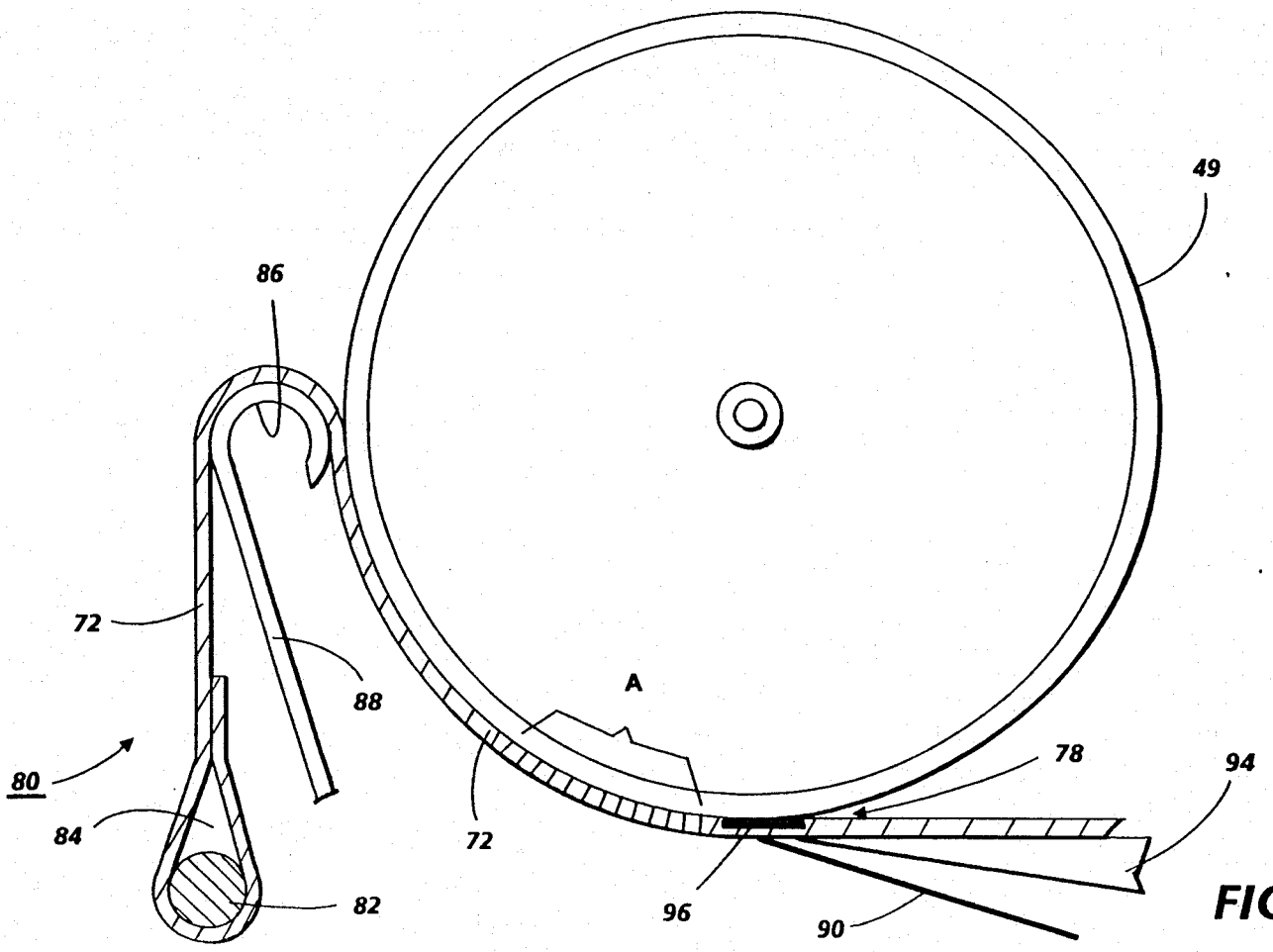
FIG. 2 is an enlarged view of the heat and pressure fuser shown in FIG. 1.

The fuser appratus 48 in the preferred embodiment also comprises a non-rotating, elongated pressure web member 72. As viewed in FIGS. 1 and 2, one end of web 72 is anchored in a frame structure 74. The opposite end of the web is biased into engagement with the fuser roll so that the fuser roll and the web cooperate to form an enlongated nip 78 therebetween.

A pressure applying mechanism 80 creates a force between the roll and web so as to produce a frictional force therebetween that keeps the web in tension so it can provide suitable pressure to the surface of the fuser roll. Mechanism 80 is encompasses a weighted rod 82 disposed in a loop 84 formed in web 72. A portion of the web intermediate the two ends thereof rides over a curved portion 86 of a web frame or support member 88. A biasing force is applied to the frame or support member 88 to that to thereby urge the web 72 into engagement with the fuser roll 49. The force so applied is just sufficient to keep the web against the roll.

A blade member 90 has one end anchored in the frame structure 74 while its other end contacts the web at the nip area to apply a load against the web and thereby cooperate with the pressure applying mechanism 80 to effect the required pressure in the nip for satisfactory operation. The area of contact between the web and the fuser roll forms the entrace to the nip area. The blade is preferably fabricated from thermally conductive material and is mounted such that in its free state it is flat and in its operative state the edge of the blade is deflected by the fuser roll to thereby cause it to function as a leaf spring, applying the aforementioned load against the web. Edge contact of the blade produces the highest possible pressure for a given force or load. the purpose of the blade is to control paper cockle caused by the rapid drying of high moisture content paper.

According to a first aspect of the invention, the web 72 is made of a coated fiberglass with a suitable theromoplastic material, polytetrofluroethylene (herein after referred to as PTFE). PTFE is a fluorocarbon resin currently sold under the trademark "Teflon" by the E.I. duPont de Nemours and Company, Inc. the surface of the web is rendered electrically conductive by the addition of a graphite coating to the fabric. By using a conductive web, the surface friction and staticizing tendency are reduced and material conformability is enhanced.

According to a second aspect of this invention, web 72 is perforated over an area downstream from entrance nip 78. An area A is indicated as the perforated area but a smaller or larger area may be required depending on the system application. The perforation can be made by any desired method; the can be random and of sufficient number to allow moisture from the copy paper being fused to escape therethrough to the outer surface of the web, thus greatly increasing the heat transfer from the fuser wall to the media. This embodiment has been found, for example, to permit the use of high moisture content tracing paper to be utilized as the copy substrate. Excess oil from the fuser roll 49 can also be vented through these perforations thru perforations and wiped from the outer surface of the web.

According to a third aspect of the invention, an extended teflon strip 96 is incorporated into the width of the web member 72 at nip area 78. Pressure blade 90 is mounted so as to increase the nip pressure.

This arrangement of elements serve to greatly reduce stalling of light weight copy media which enter the fuser nip by ensuring that the friction between the copy media and the web member is lower than the friction between the copy media and the fuser roll.

What is claimed is:

1. Heat and pressure fuser appratus for fixing toner images to copy substrates, said appartus comprising:

a fuser roll;

means for elevating the temperature of said fuser roll;

a pressure applying member having an elongated surface contacting said fuser roll to form a nip therebetween through which copy substrates pass with toner images carried thereby contacting said fuser roll said member having an electrically conductive surface proximate the fuser roll and means for mounting said pressure applying member and for urging substantially the entire surface thereof into pressure engagement with said fuser roll.

2. Apparatus according to claim 1, said pressue applying member having perforations in an area of the member downstream from said nip.

3. Apparatus according to claim 1, said pressure applying member incorporating a polytetrafluoroethylene strip extending the width of the nip area.

4. Apparatus according to claim 1, said pressure applying member comprising a fiberglass material coated with thermoplastic material, said conductive surface incorporating a graphite coating.

* * * * *